United States Patent [19]

Lopez

[11] Patent Number: 4,876,548

[45] Date of Patent: Oct. 24, 1989

[54] PHASED ARRAY ANTENNA WITH COUPLERS IN SPATIAL FILTER ARRANGEMENT

[75] Inventor: Alfred R. Lopez, Commack, N.Y.

[73] Assignee: Hazeltine Corp., Greenlawn, N.Y.

[21] Appl. No.: 943,419

[22] Filed: Dec. 19, 1986

[51] Int. Cl.[4] ..... H01Q 3/22

[52] U.S. Cl. ..... 342/368; 342/373; 455/304

[58] Field of Search ..... 455/304, 305; 342/368, 342/373

[56] References Cited

U.S. PATENT DOCUMENTS

| | | | |
|---|---|---|---|
| 3,255,450 | 6/1966 | Butler | 342/373 |
| 3,345,585 | 10/1967 | Hildebrand | 342/373 |
| 3,803,625 | 4/1974 | Nemit | 342/373 |
| 3,938,160 | 2/1976 | Mailloux et al. | 342/373 |
| 4,010,474 | 3/1977 | Provencher | 342/373 |
| 4,143,379 | 3/1979 | Wheeler | 342/373 |
| 4,163,974 | 8/1979 | Profera | 342/373 |
| 4,188,633 | 2/1980 | Frazita | 342/373 |
| 4,231,040 | 10/1980 | Walker | 342/373 |
| 4,321,605 | 3/1982 | Lopez | 342/373 |
| 4,466,131 | 8/1984 | Ghose et al. | 455/305 |
| 4,633,259 | 12/1986 | Hrycak | 342/373 |
| 4,638,317 | 1/1987 | Evans | 342/373 |
| 4,710,281 | 1/1973 | Thomas | 342/373 |

*Primary Examiner*—Thomas H. Tarcza
*Assistant Examiner*—David Cain
*Attorney, Agent, or Firm*—E. A. Onders

[57] ABSTRACT

A lossless spatial filter having N input ports and N output ports and printed on a single substrate. The filer is used in combination with an antenna system which radiates wave energy signals into a selected angular region of space and into a desired radiation pattern. The aperture of the system includes a plurality of N antenna elements. The antenna elements are arranged along a predetermined path and each element is connected to only one output port of the spatial filter. A beam steering unit controls the direction of radiation. A signal generator supplies a power divider having N output signal ports each connected to a phase shifter controlled by the beam steering unit.

15 Claims, 10 Drawing Sheets

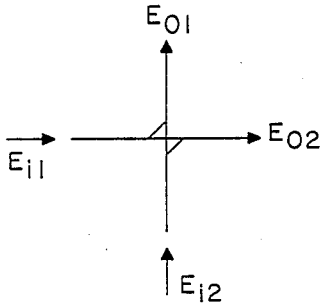
FIG. 6a
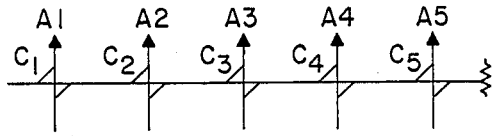
FIG. 6c
$$\frac{E_{01}}{E_{i1}} = T$$
$$\frac{E_{02}}{E_{i1}} = C$$
$$\frac{E_{02}}{E_{i2}} = -T$$
$$\frac{E_{01}}{E_{i2}} = C$$
FIG. 6b
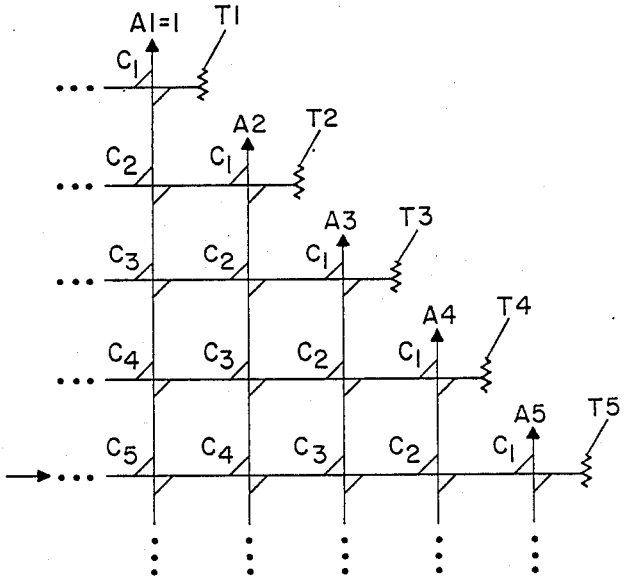
FIG. 6d
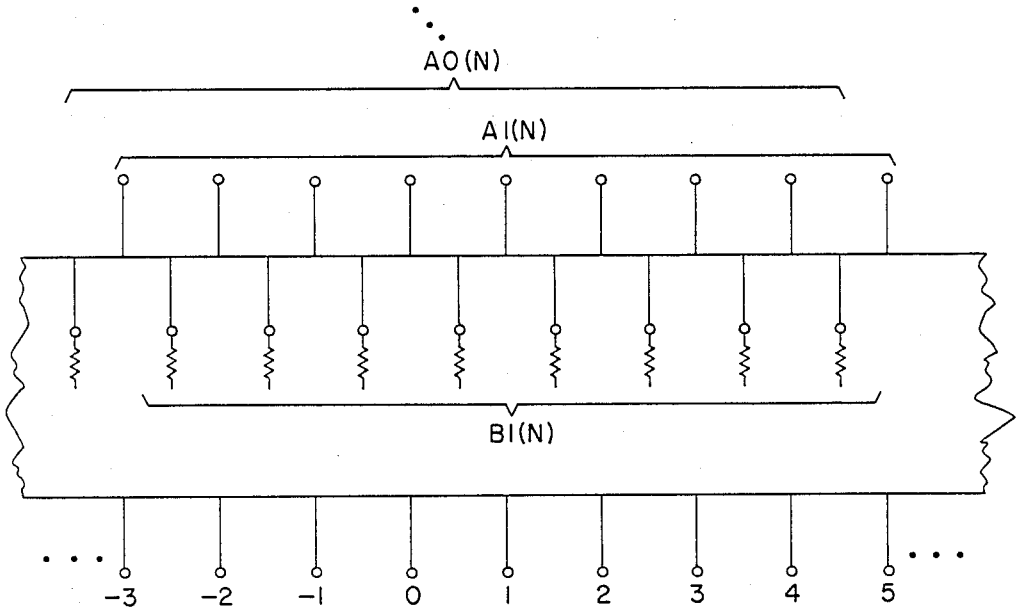
FIG. 7

| OUTPUT PORT NO. | AMPLITUDE (-dB) | AMPLITUDE (VOLTAGE RATIO) | PHASE (DEG) |
|---|---|---|---|
| 1 | 6.5 | 1.000 | -180.0 |
| 2 | 100 | 0.000 | -68.8 |
| 3 | 3.5 | 1.413 | -137.6 |
| 4 | 0 | 2.113 | -206.4 |
| 5 | 0 | 2.113 | -275.2 |
| 6 | 3.5 | 1.413 | -344 |
| 7 | 100 | 0.000 | -412.8 |
| 8 | 6.5 | 1.000 | -301.6 |

OPTIMUM EXCITATIONS $C_1$ = 0.8477 (-1.435dB)

$C_2 = C_4$ = 1.000 (0dB)

$C_3$ = 0.5668 (-4.931 dB)

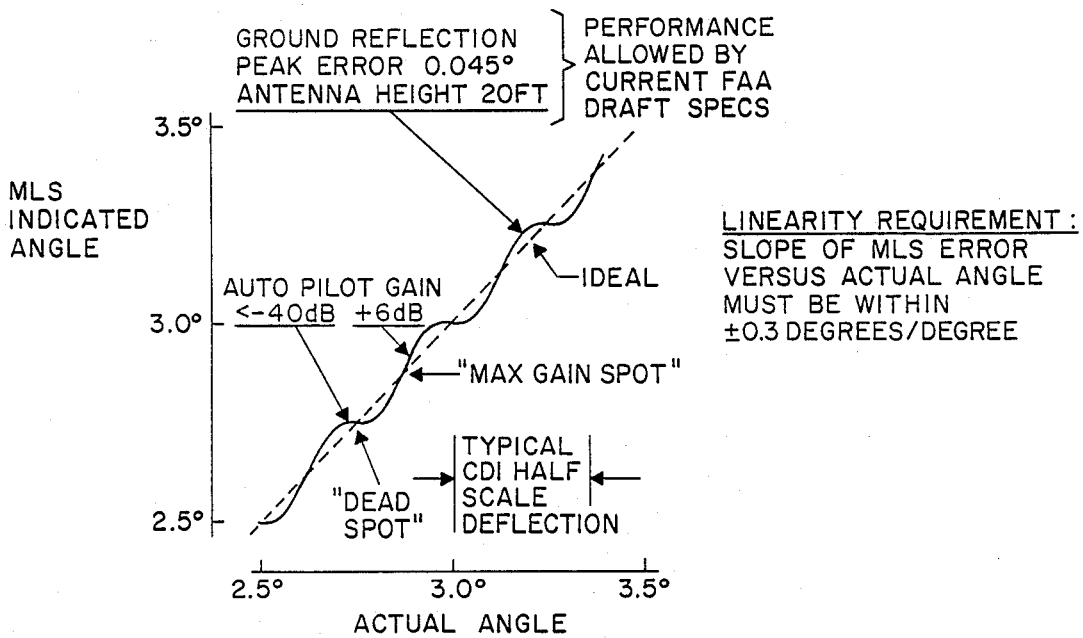

FIG. 11

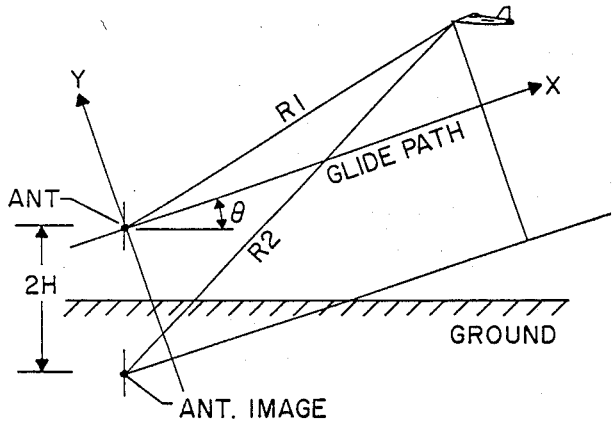

$\mu$S/DEG(3°GP) MAX SIDELOBE ERROR (DEG)

MLS GLIDE PATH DEVIATION INDICATION ($\mu$S) $= 208\left[57.3\frac{Y}{X} + A\sin\left(\frac{2\pi}{\lambda}\underbrace{(R2-R1)}_{\text{PATH DIF.}} + \phi\right)\right]$ $$R1 = \sqrt{X^2+Y^2+Z^2}$$

Z = ANTENNA OFFSET FROM CENTERLINE OF RUNWAY $$R2 = \sqrt{(X+2H\sin\theta)^2+(Y+2H\cos\theta)^2+Z^2}$$

FOR $\frac{H}{X}<<1$, $\frac{Y}{X}<<1$, $\frac{Z}{X}<<1$, AND $\theta = 3°$

MLS GP DEV IND $\approx 208\left[57.3\frac{Y}{X} + A\sin\left(4\pi\frac{H}{\lambda}\frac{Y+H}{X} + \phi\right)\right]$

FIG. 12

PHASED ARRAY ANTENNA WITH COUPLERS IN SPATIAL FILTER ARRANGEMENT

BACKGROUND OF THE INVENTION

1. Field of the Invention

This invention relates to array antenna systems and particularly to such systems wherein the antenna element pattern is modified by providing a lossless spatial filter between the antenna input ports and the antenna elements so that the effective element pattern associated with each input port is primarily within a selected angular region of space.

2. Description of the Prior Art

An array antenna system may be designed to transmit a desired radiation pattern into one of a plurality of angular directions in a selected region of space. In accordance with the prior art designs of such array antennas, each of the antenna elements has an associated input port. By variation of the amplitude and/or phase of the wave energy signals supplied to the input ports, the antenna pattern can be electronically steered in space to point in a desired radiation direction or otherwise controlled to radiate a desired signal characteristic, such as a time reference beam scanning pattern. When it is desired to have an array antenna radiate its beam over a selected limited region of space, it is preferable that the radiation pattern of the individual antenna elements also be primarily within the selected angular region. This permits maximum element spacing while suppressing undesired grating lobes.

In certain systems, control of the element pattern by modification of the physical shape of the antenna element may be impractical because of a desired element pattern may require an element aperture size which exceeds the necessary element spacing in the array. A practical approach to overcome the physical elements size limitation is to provide networks for interconnecting each antenna input port with more than one antenna element, so that the effective element pattern associated with each input port is formed by the composite radiation of several elements. These networks can be realized by printed circuit techniques using a single substrate layer.

One prior art approach to this problem has been described by Nemit in U.S. Pat. No. 3,803,625, incorporated herein by reference. Nemit achieves a larger effective element size by providing intermediate antenna elements between the primary antenna elements and coupling signals from the primary antenna element ports to the intermediate element ports. This tapered multielement aperture excitation produces some measure of control over the radiated antenna pattern.

A more effective prior art antenna coupling network is described by Frazita et al. in U.S. Pat. No. 4,041,501 incorporated herein by reference and assigned to the same assignee as the present invention. According to the technique of Frazita, the antenna elements are arranged in element modules, each module is provided with an input port. Transmission lines are coupled to all of the antenna element modules in the array. The transmission lines couple signals applied to any of the ports to selected elements in all the antenna element modules of the array. This antenna, herein referred to as a COMPACT antenna, provides an effective element aperture which is coextensive with the array aperture.

Still another effective prior art antenna coupling network is described by Wheeler in U.S. Pat. No. 4,143,379, incorporated herein by reference and assigned to the same assignee as the present invention. According to the technique of Wheeler, cross coupling ports are employed to couple wave energy signals to modules which are contiguous to each module.

Yet, another technique is shown in U.S. Pat. No. 4,168,503 which describes an antenna array with a printed circuit lens in a coupling network. A radiated signal, received by each one of a plurality of spatially separated antennas forming a directive array, is coherently recovered by the lens. The lens comprises a plurality of vertically standing and circularly arranged printed circuit panels, each of which includes a conductor strip connected at one end to each antenna. A plurality of semi-elliptical circuit panels are affixed to the vertical panels at a predetermined angle. Metal strips plated on the semi-elliptical panels provide the desired time delay to the antenna signals. A combining strip couples the time delay strips and provides a combined output signal at one end of the semi-elliptical pattern. The angle at which the semi-elliptical boards are affixed to the vertical boards corrects for time delay distortion caused by the placement of the combining strip. This configuration cannot be implemented using printed circuit techniques on a single substrate layer.

U.S. Pat. No. 4,321,605 describes an array antenna system having at least a 2:1 ratio of antenna elements to input terminals interconnected via primary transmission lines. Secondary transmission lines are coupled to and intersecting a selected number of the primary transmission lines. Signals supplied to any of the input terminals are coupled primarily to the elements corresponding to the input terminal, and are also coupled to other selected elements.

In time reference scanning beam systems such as microwave landing systems (MLS), there may be a linearity requirement for the glide path guidance i.e., the difference between the actual and indicated angle must be within a limited range. There is also a requirement to minimize the field monitor distance for the glide path antenna. Particularly in MLS, this invention provides a non-thinned or fully filled array which may be used to achieve linearity and minimize the field monitor distance.

SUMMARY OF THE INVENTION

It is an object of the present invention to provide an alternate array system having an antenna element pattern formed by a spatial filter between the antenna element input ports and the antenna elements.

It is another object of this invention to provide a non-thinned antenna system i.e., an antenna system wherein the number of antenna input ports equals the number of antenna element output ports so that there is no reduction ratio in the number of radiators to the number of phase shifters.

It is another object of this invention to provide an antenna system which does not generate grating lobes.

It is still another object of this invention to provide a lossless spatial filter having a 1:1 input/output ratio which employs a minimum number of couplers and terminations.

It is another object of this invention to provide a lossless spatial filter having flexibility in controlling the spatial filter radiation pattern, meeting linearity requirements and minimizing field monitor distances.

In accordance with the invention, the antenna system radiates wave energy signals into a selected angular region of space and into a desired radiation pattern. The system includes a lossless spatial filter having N input ports and N output ports. The aperture of the system comprises a plurality of N antenna elements. The antenna elements are arranged along a predetermined path and each element is connected to only one output port of the spatial filter.

A beam steering unit controls the direction of radiation and includes N phase shifters and means for controlling of phase shifters. Each phase shifter has a phase shifter input port and a phase shifter output port which is connected to only one input port of the spatial filter. The antenna also includes a supply means for supplying wave energy signals. The supply means includes a signal generator supplying a power divider having N output signal ports, each output port connected to only one phase shifter input port.

For a better understanding of the present invention, together with other and further objects, reference is made to the following description, taken in conjunction with the accompanying drawings, and its scope will be appointed out in the appended claims.

Figure 1:
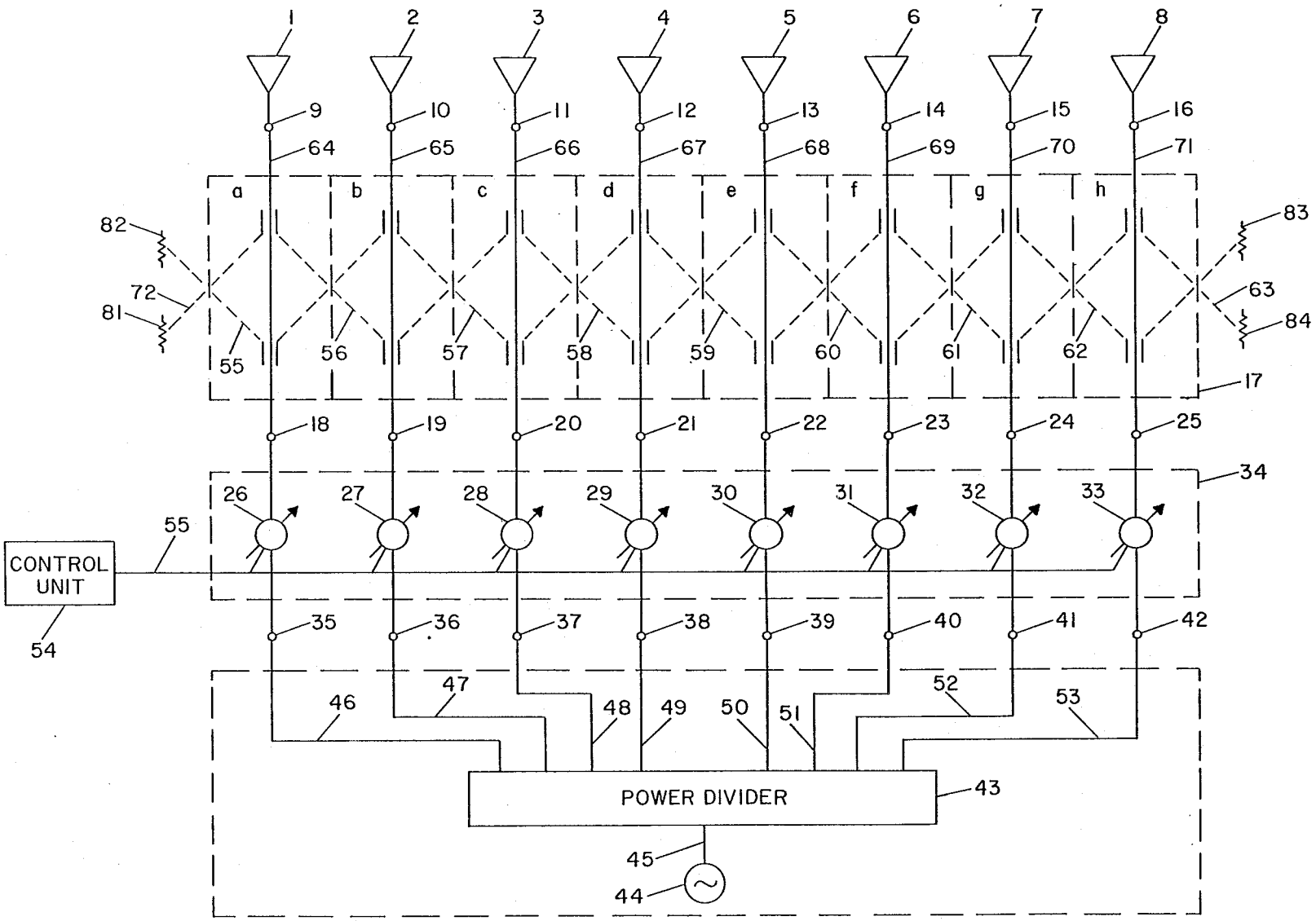
FIG. 1 is a conceptual diagram of an antenna system including a three level spatial filter wherein signals applied to an antenna input port are provided to the antenna element associated with the port and to the antenna elements adjacent to the associated element.

FIGS. *2a–2b* are a plan view of a printed circuit coupling network of the three level spatial filter illustrated in FIG. 1.

Figure 3:
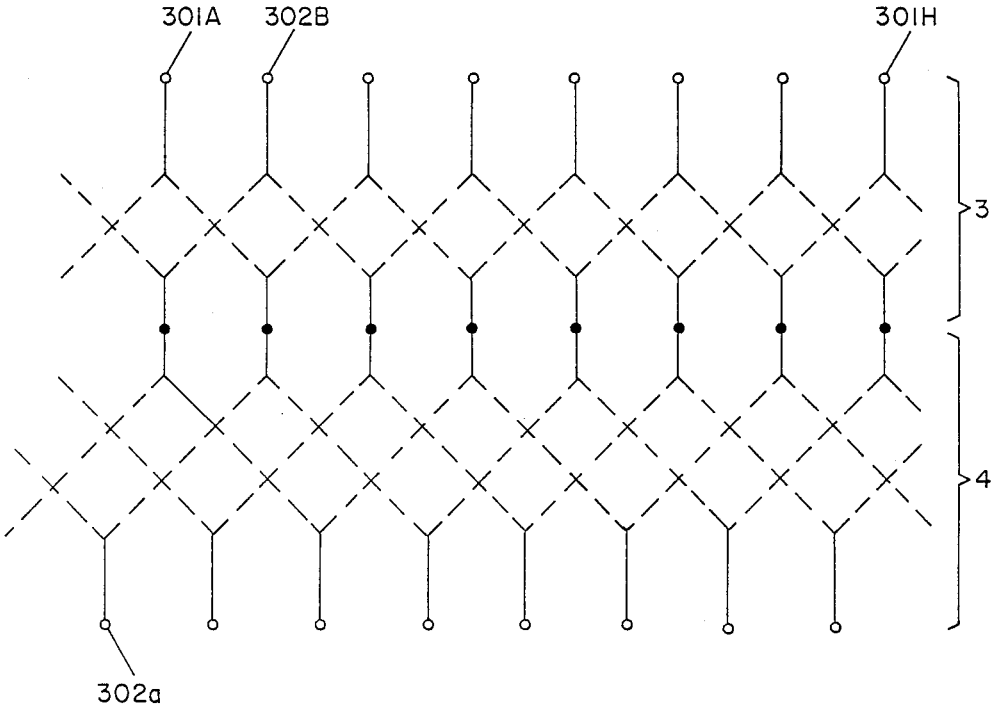

FIG. 3 is a conceptual diagram of an antenna system in accordance with the present invention including a three level spatial filter cascaded with a four level spatial filter.

Figure 4:
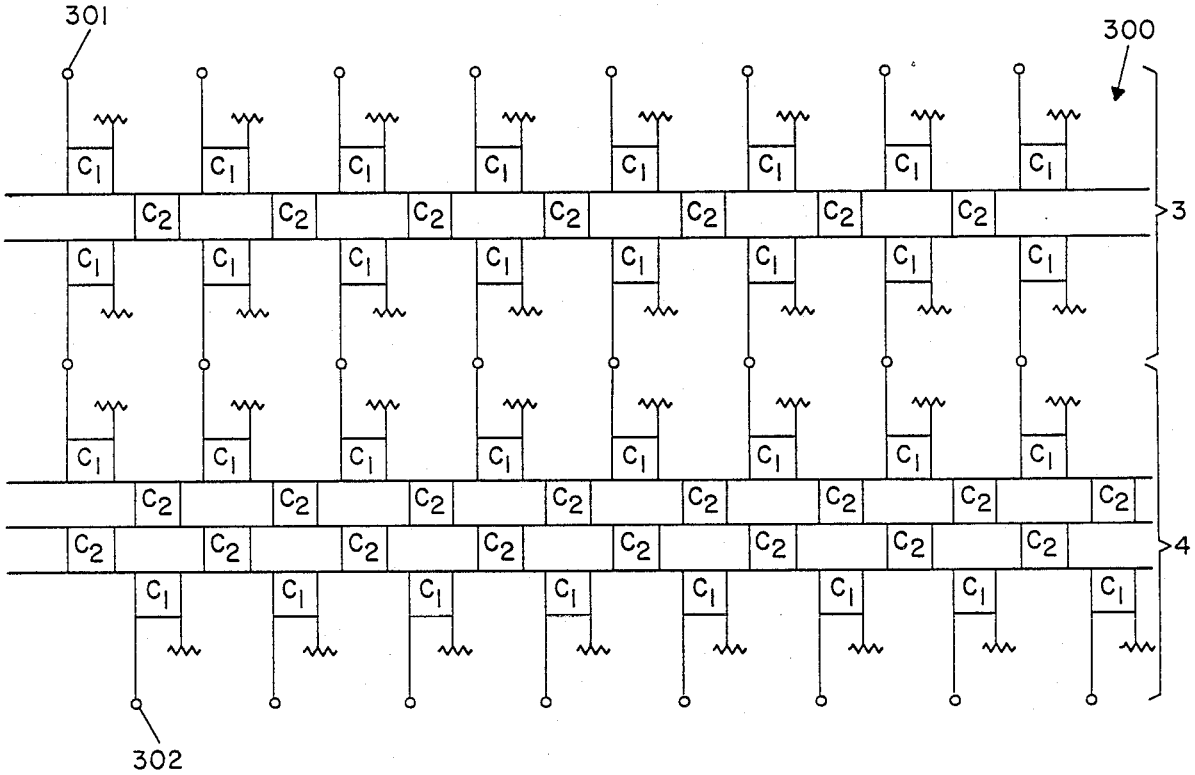

FIG. 4 is a plan view of a printed circuit coupling network of the cascaded spatial filters illustrated in FIG. 3.

Figure 5A:
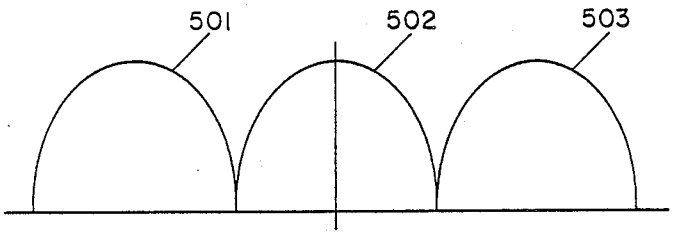
Figure 5B:
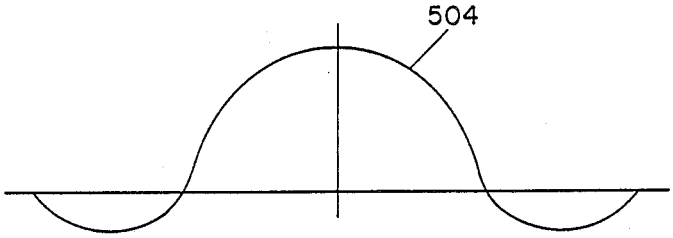
Figure 5C:
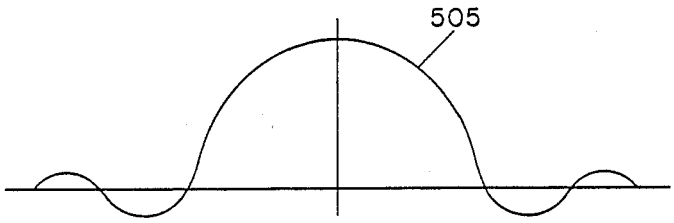

FIGS. 5A, 5B and 5C are antenna patterns for antennas according to the invention employing spatial filters having two level, three level and four level coupling, respectively.

FIG. 6A illustrates a schematic diagram of a coupler and its relative inputs and outputs.

FIG. 6B is a listing of the formulas which define the coupler values and the termination values.

FIG. 6C illustrates a schematic diagram of a series coupler network.

FIG. 6D is a generalized schematic representation of a five level spatial filter.

FIG. 7 illustrates a prototype network for an infinite spatial filter antenna to be employed with the invention.

Figure 8A:
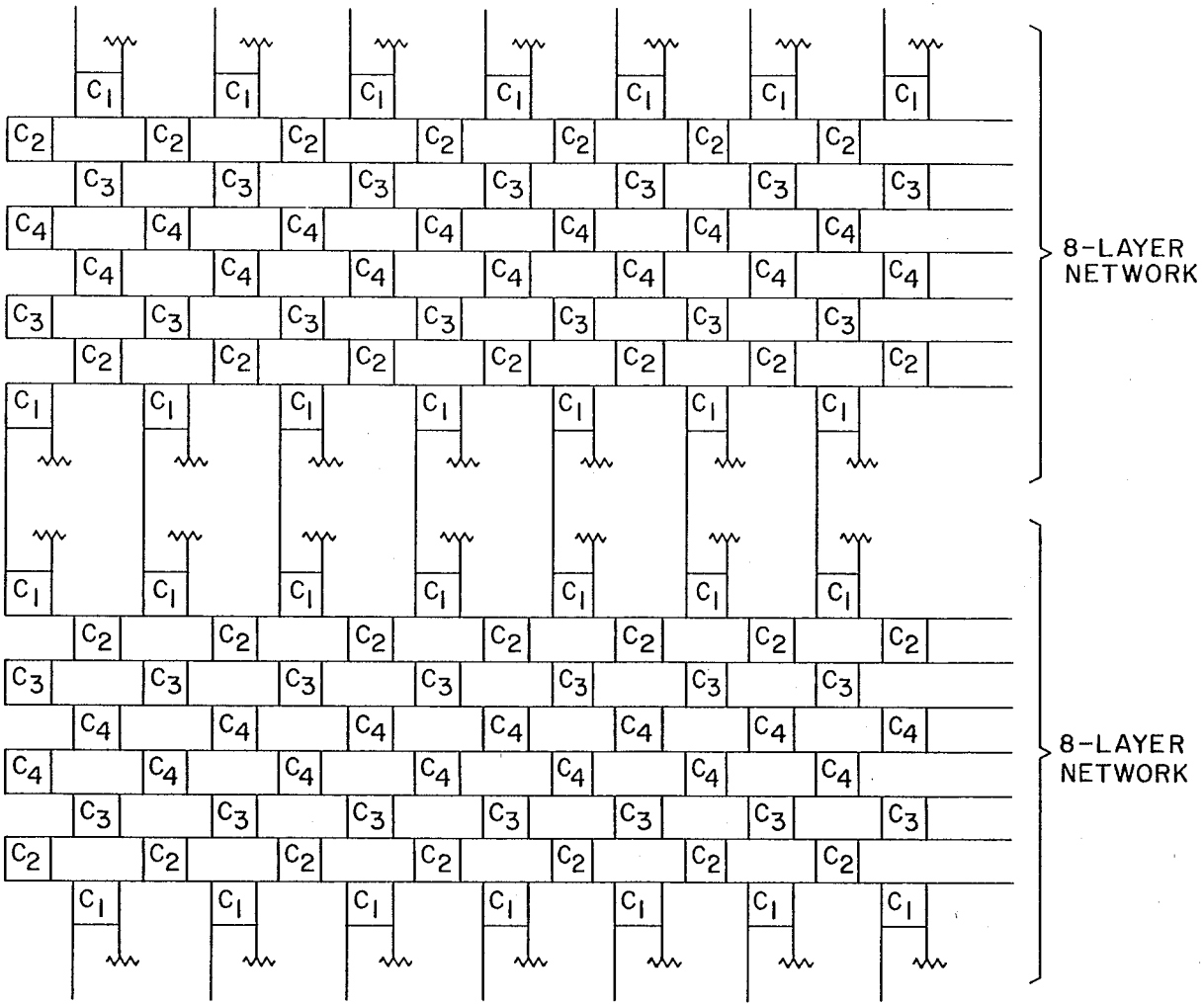

FIG. 8A is a schematic diagram of an antenna system of two cascaded 8-coupler spatial filters according to the invention.

Figures 8B, 8C:
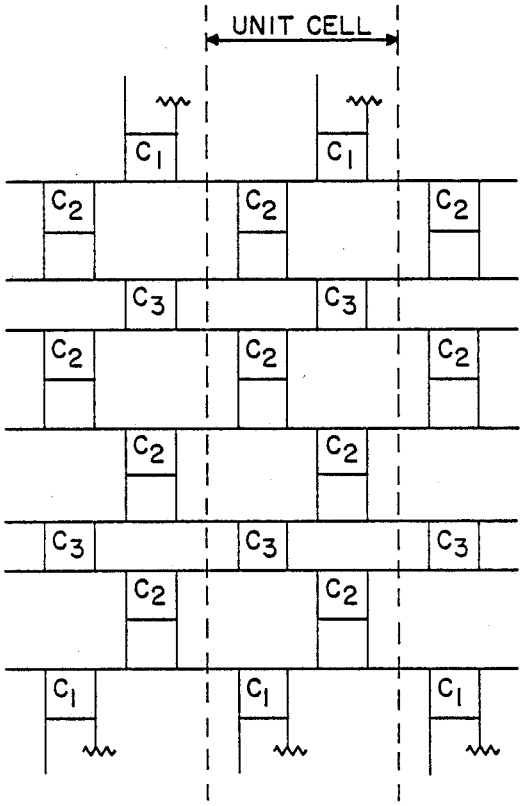

FIG. 8B is a table of the optimum excitations for an 8-port spatial filter according to the invention.

FIG. 8C is a schematic diagram of a unit cell of a modular antenna system of two cascaded 4-coupler spatial filters according to the invention.

Figure 9:
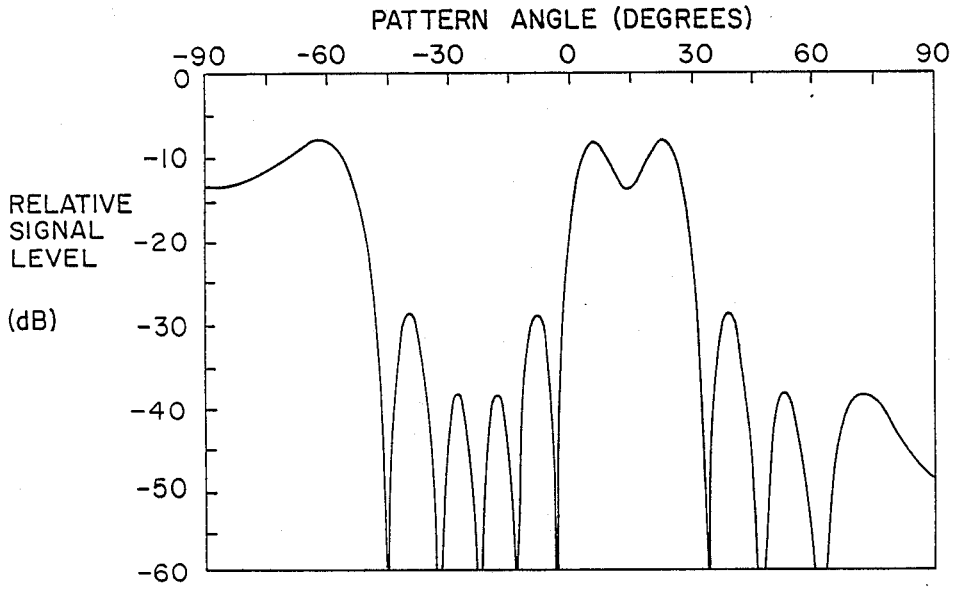
Figure 10:
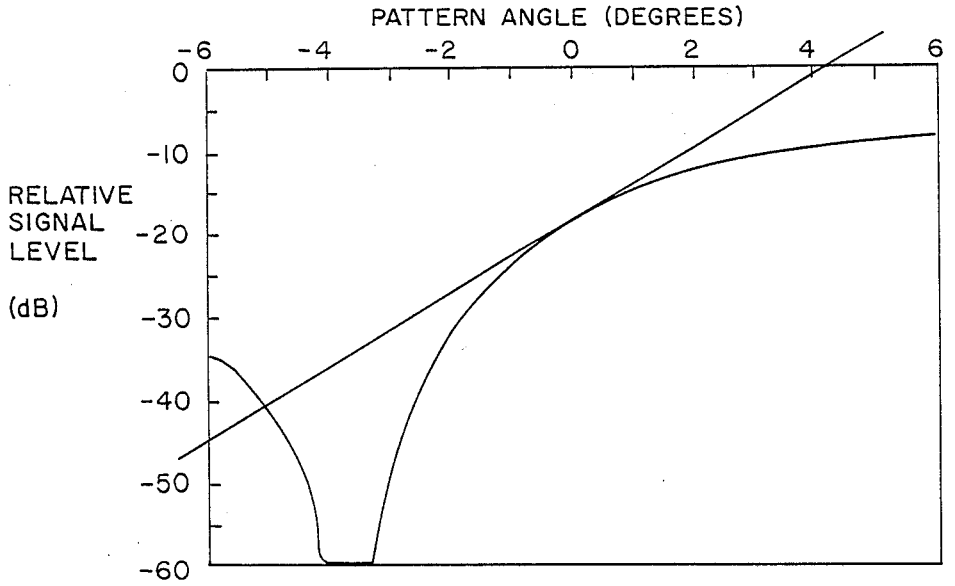

FIGS. 9 and 10 illustrate a computed antenna pattern for the zero-thinned spatial filter shown in FIG. 8A.

FIG. 11 is a graph illustrating the linearity requirements which limits the deviation from the ideal linear relationship of the MLS guidance angle and the actual angle.

FIG. 12 illustrates the geometry and formulas of a model of a flat horizontal surface used to quantify the effects of sidelobe radiation on the performance of an automatic flight control system.

Figure 13:
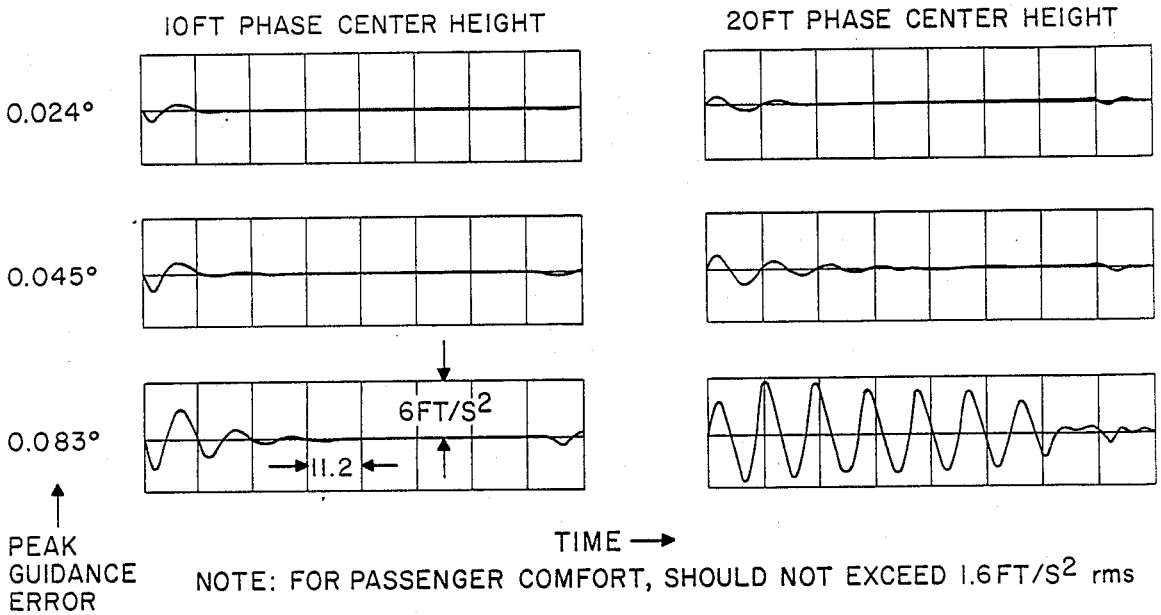
Figure 14:
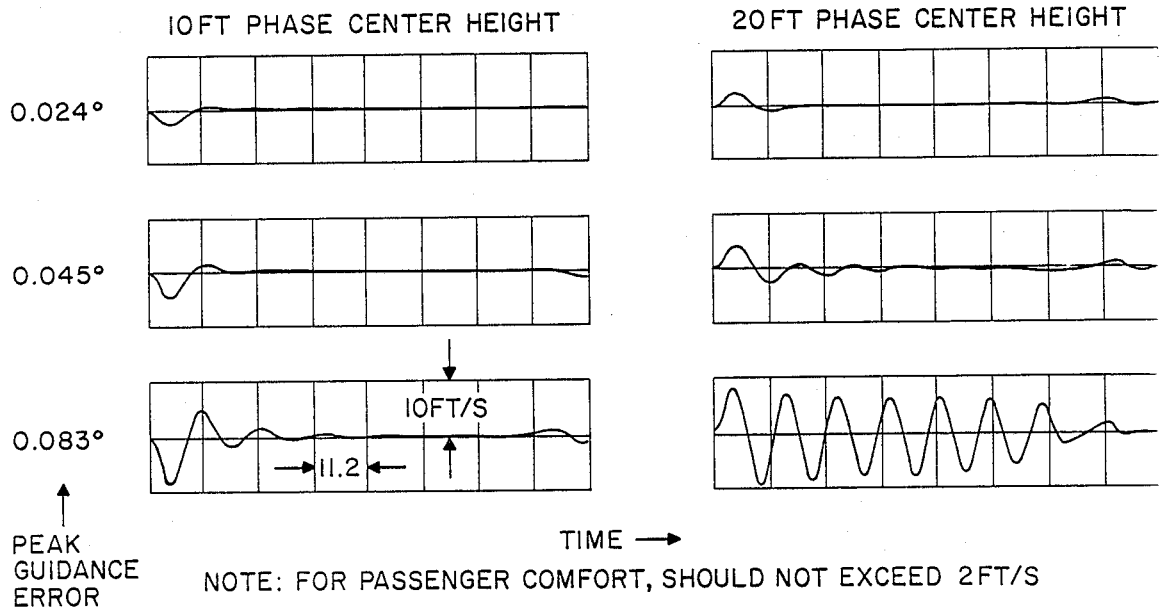
Figure 15:
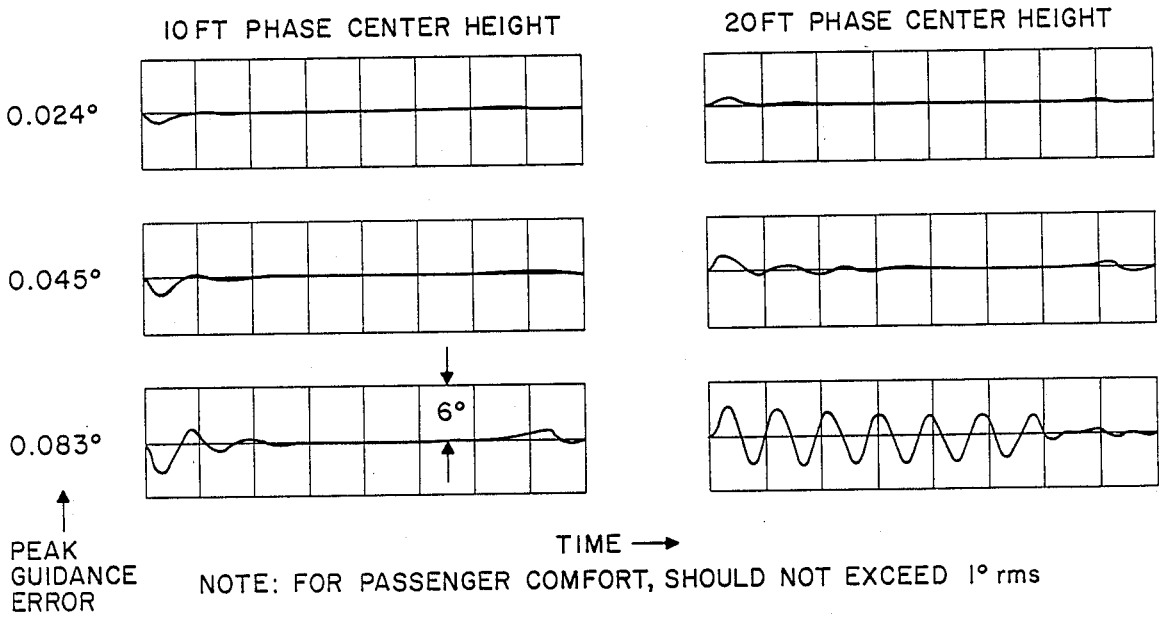

FIGS. 13, 14, and 15 summarize the simulation results of vertical acceleration, vertical velocity, and vertical attitude, respectively, with regard to the peak MLS guidance error for 10 feet and 20 feet elevation antenna phase center heights when passenger comfort is considered.

DETAILED DESCRIPTION OF THE INVENTION

FIG. 1 is a schematic diagram illustrating an antenna system in accordance with the present invention. The diagram of FIG. 1 includes a plurality of antenna elements 1–8 arranged in a predetermined path which, in this case, is a straight line. Each antenna element is connected to one and only one output port 9–16 of spatial filter 17. The spatial filter is comprised of a plurality of modules A through H, one module for each antenna element. Spatial filter 17 includes 8 input ports, 18–25 each connected to the output of one and only one phase shifter 26–33. The array of phase shifters 26–33 form beam steering unit 34. The inputs 35–42 of the phase shifters are connected to one and only one output of power divider 43 which is fed by signal generator 44. The power divider and signal generator form a supply means for supplying wave energy signals. Although filter 17 has been illustrated as symmetrical, it is contemplated that spatial filters according to the invention may be unsymmetrical.

Referring to the signal path of wave energy signal supplied by signal generator 44, the original signal is provided via line 45 to power divider 43 which divides the signal into eight equal components. Each component is provided via lines 46–53 to only one input of beam steering unit 34. For example, referring to the left-most potion of the antenna system, line 46 provides the signal component to input 35 of beam steering unit 34. The component then passes through phase shifter 26 which may shift the phase of the component according to instructions received from control unit 54 via control line 55. The output of phase shifter 26 is provided to input port 18 of spatial filter 17. The signal component provided to input port 18 is provided to output port 9 which is connected to antenna element 1 and is also provided by a coupling arrangement to element 2 which is adjacent to antenna element 1.

Spatial filter 17 couples component signals which are provided to any input to the antenna element associated with the input and to elements adjacent to the associated element. Couplers 56–63 couple signals which are provided to an associated antenna element to the antenna element which is to the left of the associated antenna element. The component signal provided to an input is transmitted to the antenna element associated with the input by transmission lines 64–71. For example, the component signal provided by branch 39 of the power divider 43 is fed through phase shifter 30 and provided to input 22 of spatial filter 17. Input 22 is connected by transmission line 68 to its associated output 13 and antenna element 5. The component signal is also coupled by coupler 59 to antenna element 4 which is to the left of and adjacent to antenna element 5. Similarly, component signals provided to an input are also coupled to antenna elements adjacent and right of the associated antenna element by couplers 72–80. For example, the component signal provided by branch 49 of the power divider to input 38 of phase shifter 29 passes through phase shifter 29 and is provided to input 21 of the spatial filter 17. The component signal is then provided to output 12 by transmission line 67. Output 12 is directly connected to antenna element 4. Element 5 is adjacent to and to the right of antenna element 4 and receives a portion of the component signal via coupler 76. Element 3 is adjacent to and to the left of antenna element 4 and receives a portion of the component signal via coupler 58.

Spatial filter 17 is shown in modular form. As a result, the input to coupler 72 is terminated by termination 81 because there is no antenna element to the left of antenna element 1. Similarly, the output from coupler 56 is terminated by termination 82 because there is no antenna element to the left of antenna element 1 to receive the component signal provided to input 18. On the right side of spatial filter 17, coupler 80 is terminated by termination 83 and coupler 63 is terminated by termination 84 because there is no antenna element to the right of antenna element 8 to receive the couple signal from coupler 80 or to provide a coupled signal via coupler 63.

Figure 2:
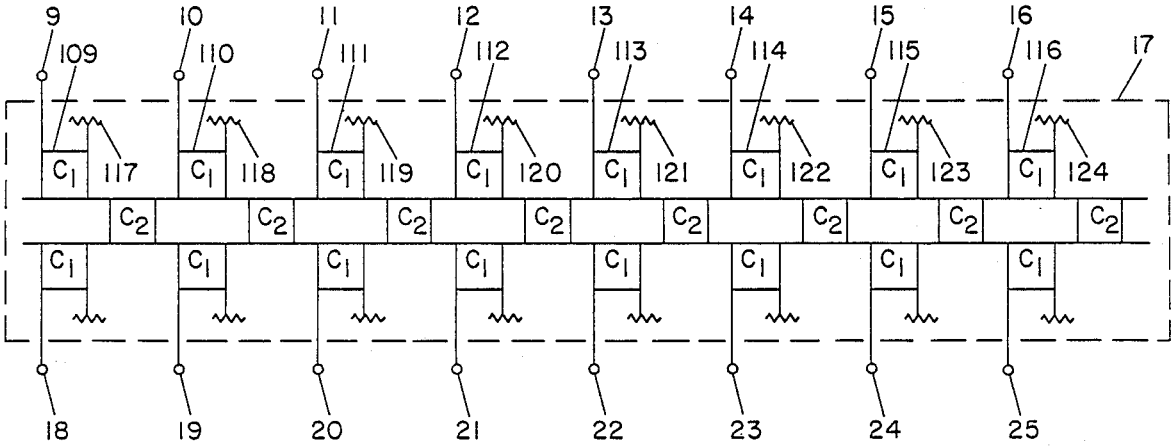

FIG. 2 illustrates a plan view of a printed circuit coupling network useful as the spatial filter 17 of FIG. 1. Network 17 includes input ports 18–25 connected to the outputs of beam steering unit 34. These input ports are connected to a first series of couplers $C_1$ shown in detail in FIG. 2A. Coupler $C_1$ as well as all other couplers may be standard microstrip network couplers having a predetermined coupling ratio. The specific coupling ratio depends on the width, length and on the thickness of the transmission lines within the coupler. By convention, signals provided to the inputs 101 and 102 of coupler $C_1$ are coupled to the outputs 103 and 104 according to a predetermined ratio. In the case of coupler $C_1$, input 102 is terminated by termination 105 resulting in any component signal which is supplied to input 101 being distributed to outputs 103 and 104 such that $C_1^2+T_1^2=1$.

Figure 2A:
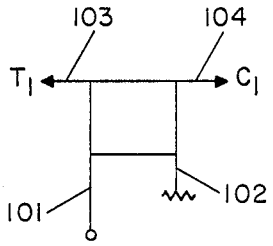
Figure 2B:
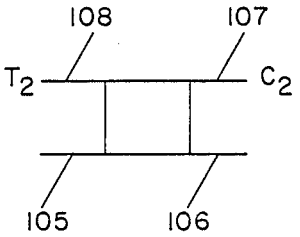

Following the first array of couplers $C_1$ is a second array of couplers $C_2$ illustrated in more detail in FIG. 2B. Signals provided to inputs 105 and 106 are combined and transmitted to output 108 at a ratio $T_2$ and coupled to output 107 at a ratio $C_2$ such that $T_2^2+C_2^2+1$. Completing the three level spatial filter 17 is a third series of couplers 109–116. According to the invention, these couplers have the same configuration as coupler $C_1$. Couplers 109–116 work in the same manner as coupler $C_1$ as shown in FIG. 2A by combining signals provided to their inputs to the outputs 9–16 of spatial filter 17.

As specified by the invention, spatial filter 17 is ideally lossless (except for dissipative losses) and for that reason the relationships $$C_1^2+T_1^2=1 \text{ and } C_2^2+T_2^2=1$$

must apply to the power (voltage) passing through each coupler $C_1$ and $T_1$, respectively. The following relationship ensures the lossless condition for the network:

$$C_1^2 = \tfrac{1}{2}(1 + \sqrt{1 - C_2^2}) \quad (1)$$

This relationship can be derived by setting the inputs at 18–25 equal to unity and the inputs to the terminations 117–124 equal to zero.

As used in regard to the invention, a non-thinned spatial filter is a filter formed by an array of couplers. The array is essentially lossless in that the power dissipated within terminations is minimized.

FIG. 3 is a schematic diagram of an antenna system in accordance with the invention including a three/four level cascaded spatial filter 300. In general, this spatial filter may be used in combination with the antenna system as shown in FIG. 1 by replacing spatial filter 17 with spatial filter 300. Each antenna element 1–8 would then be connected to one and only one output port 301 of the spatial filter 300. Spatial filter 300 is comprised of a plurality of modules A through H, one module for each antenna element. Spatial filter 300 includes input ports 302 each connected to one and only one of the outputs of a phase shift network.

FIG. 4 is a pan view of a printed circuit coupling network of the cascaded spatial filter 300 illustrated in FIG. 3. Network 300 includes input ports 302 connected to the output ports of a beam steering unit. These input ports are connected to a first series of couplers C1 shown in detail in FIG. 2A. Following the first array of coupler C1 is a second array of couplers C2 illustrated in more detail in FIG. 2B. Following the second array of couplers C2 is a third array of coupler C2. Completing the four level spatial filter 300 is a fourth series of couplers C1. According to the invention, for symmetrical excitations, couplers C1 at the beginning and end of the array and intermediate couplers C2 have the same configuration. The following relationship ensures the lossless condition for the networks $$C1^2 = \tfrac{1}{2} + C2\sqrt{1 - C2^2} \quad (2)$$

FIG. 5A illustrates an ideal antenna pattern for an antenna according to the invention employing spatial filters having a two level coupling. Essentially this coupling creates lobes 501, 502 and 503. FIG. 5B illustrates a typical antenna pattern employing a three level spatial filter which forms a single lobe 504. FIG. 5C illustrates a typical antenna pattern for a four level spatial filter generating a more well defined single lobe 505.

Synthesis Procedure For Five Level Non-Thinned Spatial Filter

Step 1: Referring to FIGS. 6A, 6B, 6C, and 6D, determine initial values for couplers C1–C5
(a) specify desired excitations A1–A5
(b) specify C1
(c) compute C2–C5 using FIG. 6C

Step 2: Compute actual excitations A1′–A5′ according to the following formulas:

| | | |
|---|---|---|
| (a) | A1′ = | T5C4C3C2C1 |
| (b) | A2′ = | C5T4C3C2C1 − T5T4T3C2C1 − T5C4T3T2T1 − T5C4C3T2T1 |
| (c) | A3′ = | C5C4T3C2C1 − T5C4T3C2T1 − T5T4T3T2T1 − T5T4C3T2C1 − C5T4C3T2T1 − C5T4T3T2C1 |
| (d) | A4′ = | C5C4C3T2C1 − T5T4C3C2T1 − C5T4T3C2T1 − C5C4T3T2T1 |
| (e) | A5′ = | C5C4C3C2T1 |

Step 3: Adjust values for couplers C2–C5

(a) adjust C5 such that $$\frac{A2'}{A1'} = \frac{A2}{A1}$$

(b) adjust C4 such that $$\frac{A3'}{A2'} = \frac{A3}{A2}$$

(c) adjust C3 such that $$\frac{A4'}{A3'} = \frac{A4}{A3}$$

(d) adjust C2 such that $$\frac{A5'}{A4'} = \frac{A5}{A4}$$

Step 4: Recompute actual excitations A1'–A5' (see Step 2 for formulas for A1'–A5')

Step 5: Normalize actual excitations by computing A''–A5''

(a) Let A1''=1. Then, $$A2'' = \frac{A2'}{A1'} \quad \text{(b)}$$

$$A3'' = \frac{A3'}{A1'} \quad \text{(c)}$$

$$A4'' = \frac{A4'}{A1'} \quad \text{(d)}$$

$$A5'' = \frac{A5'}{A1'} \quad \text{(e)}$$

Step 6: Compute deviation S between normalized actual excitations A1''–A5'' and desired excitations A1–A5

$$S = \frac{\Sigma\,(AN'' - AN)^2}{\Sigma\,(AN)^2} \qquad N = 1, 2, \ldots, 5$$

Step 7: Repeat steps 3–6 until deviation S is within an acceptable limit

Step 8: Repeat steps 1-7 until ratio of power in terminations $P_T$ to radiated power $P_R$ is a minimum i.e., minimize $P_T/P_R$ $$P_T=\Sigma(TN)^2;\ P_R=\Sigma(AN)^2,\ N=1,2,\ldots,5$$

For example, consider the case of a five element aperture as illustrated in FIG. 6A. Assuming the desired excitation (from step 1*a*) is:

A1=1.0000
A2=1.6086
A3=1.93156
A4=1.6086
A5=1.0000

Let C1=0.979 (from step 1*b*); then, the values of the other couplers (from step 1*c*) are:

C2=0.9502
C3=0.9366
C4=0.9600
C5=0.9852

The normalized actual excitations (steps 2–5) result in:

A1=1
A2=1.3755
A3=1.6478
A4=1.5449
A5=1.1957

The db loss (from step 8) between the normalized actual excitations (from step 5) and the desired excitations (from step 1*a*) is:

LOSS=7.12 db

Table 1 below continues the synthesis procedure.

TABLE 1

| | Five Coupler Synthesis | | | | | | | | | | |
|---|---|---|---|---|---|---|---|---|---|---|---|
| Trial | C1 | C2 | C3 | C4 | C5 | A1'' | A2'' | A3'' | A4'' | A5'' | loss |
| 1 | .979 | .9225 | .8401 | .9042 | .979 | 1 | 1.6061 | 1.932 | 1.6061 | 1 | 6.72 db |
| 2 | .98 | .9285 | .857 | .9132 | .98 | 1 | 1.608 | 1.932 | 1.611 | 1 | 6.59 db |
| 3 | .985 | .953 | .9155 | .9461 | .985 | 1 | 1.608 | 1.933 | 1.604 | 1 | 6.69 db |
| 4 | .99 | .971 | .9523 | .9685 | .99 | 1 | 1.608 | 1.931 | 1.609 | 1 | 7.68 db |
| 5 | .981 | .9343 | .8718 | .9212 | .98 | 1 | 1.6085 | 1.932 | 1.6085 | 1 | 6.53 db |

As shown in table 1, trial 5 illustrates an optimum arrangement with minimum power loss. As shown in table 2, trial 4 illustrates an optimum arrangement for a five coupler structure where the symmetry of the excitation is invoked to set C5=C1 and C4=C2.

TABLE 2

| | Five Coupler Synthesis, C5 = C1, C4 = C2 | | | | | | |
|---|---|---|---|---|---|---|---|
| Trial | C1 | C2 | C3 | A1 | A2 | A3 | loss |
| 1 | .981 | .91506 | .85575 | 1 | 1.6086 | 1.932 | 6.93 db |
| 2 | .979 | .8823 | .7849 | 1 | 1.6086 | 1.9318 | 7.90 db |
| 3 | .982 | .92425 | .8739 | 1 | 1.6086 | 1.932 | 6.80 db |
| 4 | .984 | .93866 | .90095 | 1 | 1.6086 | 1.9321 | 6.75 db |
| 5 | .986 | .95011 | .92131 | 1 | 1.6086 | 1.932 | 6.90 db |

Although the above procedure has been applied to develop a symmetrical filter, the procedure is general in nature and can also be used to develop nonsymmetrical filters. Symmetry is generally preferred to maintain simplicity and reduce complexity. Symmetrical filters usually employ redundant couplers and other structures which minimizes design efforts.

The design of a spatial filter involves the determination of coupler values for a multilayer circuit. No closed form solution is readily apparent to the synthesis of a network that produces a specified output voltage distribution. However, analysis of any network is possible. Therefore, synthesis involves the iterative trial and error procedure described above in which coupler values are gradually adjusted until the desired outputs are achieved.

Since the analysis of a complex network requires significant computer time, it is desirable to formulate an iterative algorithm that converges to the desired solution within a reasonable time. Analysis of every possible combination of coupler values could take weeks or months to evaluate on the computer. Furthermore, an infinite number of solutions exist that produce the desired amplitude distribution. The difference in solutions is the insertion loss of the resulting network. Therefore, it is necessary to determine by theoretical means the minimum possible loss, so that it will be known when an optimum solution has been achieved.

The theoretical loss of a spatial filter network is determined by conservation of power considerations. The network prototype is shown in FIG. 7. The network is symmetrical and continues to infinity in both directions. Each input excites a sub array with N outputs. The sub array outputs, resulting from adjacent inputs, overlap. The network shown in FIG. 7 has an equal number of inputs and outputs. Therefore, the input and output spacings are equal and, when all inputs are excited, each output port will be the sum of contributions from N input ports. There must be an internal termination for each output port.

The output excitation that results from input 1 is designated A1(N), whereas the output excitation resulting from input 0 is designated A0(N). Because the network is symmetrical, A1(N)=A0(N)=Aj(N). Similarly, the power terminated, designated as Bj(N), must also be equal.

The network is realized with N layers of directional couplers. To achieve the desired symmetry, all coupler values in a given layer must be equal. Furthermore, a symmetrical output excitation (Aj(1)=Aj(N), Aj(2-)=Aj(N−1), etc.), requires that the coupler values in the first layer be equal to those in the Nth layer, etc. Therefore, as an example, an 8-output network has 8 layers of couplers. If the 8-element excitation is symmetrical, C1 (coupling value for all couplers in first layer) must equal C8, C2=C7, C3=C6, and C4=C5. Therefore, there are only 4 different coupler values or unknowns that must be determined for an 8-output network.

When input power is delivered to port one, conservation of power dictates the sum of powers in A1(N) added to that internally terminated (B1(N)) must equal the input power. A normalization to an input power of 1 watt yields the equation:

$$\sum_{i=1}^{N} A1(N)^2 + \sum_{i=1}^{N} B1(N)^2 = 1 \tag{3}$$

The A's and B's are voltage coefficients. The power at each output port is equal to the square of the voltage coefficient when the system impedance is normalized to one ohm.

When all input ports are excited with equal power and in phase, the output at each port is the sum of N voltages. From symmetry and conservation of power, the sum of the power at one output port and its internal termination must equal one watt. All output ports will be equal.

$$\left[\sum_{i=1}^{N} A1(N)\right]^2 + \left[\sum_{i=1}^{N} B1(N)\right]^2 = 1 \tag{4}$$

A combination of equations (3) and (4) gives:

$$\sum_{i=1}^{N} A1(N)^2 + \sum_{i=1}^{N} B1(N)^2 = \tag{5}$$

-continued $$\left[\sum_{i=1}^{N} A1(N)\right]^2 + \left[\sum_{i=1}^{N} B1(N)\right]^2$$

If the network is to be lossless when a single input port is excited, no power can be delivered to the internal terminations (all B's=0). If that condition exists, $$\sum_{i=1}^{N} A1(N)^2 = \left[\sum_{i=1}^{N} A1(N)\right]^2 \tag{6}$$

There are few output excitations that satisfy equation 6. The least loss occurs for an excitation that does not satisfy equation 6 when $$\left[\sum_{i=1}^{N} B1(N)\right]^2 = 0 \quad \text{or} \quad \sum_{i=1}^{N} B1(N) = 0 \tag{7}$$

When that condition is met, the network will be lossless when all input ports are excited with equal amplitude and phase. The loss, when a single input port is excited and the sub array pattern has a maximum in the in-phase direction, is given by:

$$\text{loss} = \sum_{i=1}^{N} A1(N)^2 / \left[\sum_{i=1}^{N} A1(N)\right]^2 \tag{8}$$

When the sub array pattern has a maximum in a direction other than the in-phase direction, the lower bound on the loss is increased by the difference in the sub array gain in the two directions. The optimum network is one that provides the least loss. The loss that can be expected is the difference between the computed network loss and the theoretical value. Thus, if one computes the theoretical minimum loss to be 3.1 dB when a single input port is excited using equation 8, and the least loss that can actually be achieved with a realizable network is 4.6 dB, it will be found that the loss, when all inputs are excited in phase, is 1.5 dB. This 1.5 dB loss results from the consideration of the center of the sub array pattern. When the array is scanned to the sub array peak the theoretical loss is reduced to zero.

The basic spatial filter network topologies are well-known. A preferred implementation requires 17 layers and is nearly impossible to synthesize. A practical network, that closely approximates the performance of a 17-layer network, uses two cascaded 8-layer networks as illustrated 1n FIG. 8. The pattern characteristics for this network are shown in FIGS. 9 and 10 for a radiating element spacing of 0.79 wavelengths.

FIG. 11 describes the linearity requirement for MLS glide path guidance. The discussion of linearity concentrates on the elevation guidance performance, however, linearity is also a requirement for the azimuth guidance. Linearity is a subject that has generated much discussion in the MLS community. The invention provides a phased array antenna which meets the elevation linearity requirement. The spatial filter network is a practical way to satisfy the low effective sidelobe requirement which is directly related to the linearity requirement.

The linearity (autopilot) requirement limits the deviation from the ideal linear relationship of the MLS guidance angle and the actual angle (see FIG. 11). It specifies the transverse accuracy characteristic of the angle guidance signal as opposed to the longitudinal characteristics of PFN and CMN. The longitudinal characteristic causes the aircraft to deviate from the glide path (bends) or generates noise-like action of the controls. The transverse characteristic is capable of causing instability in an automatic flight control system.

After several years of discussion within the MLS community it is now generally accepted that PFN, CMN and linearity for the EL guidance equipment are all dependent on the effective sidelobe level of the antenna. The issue has been which one of the three characteristics (PFN, CMN or linearity) is the driver with respect to the specification of the effective sidelobe level. The Path Following Noise (PFN) relates to the path following mean course error and is caused by any frequency component that an aircraft can follow. The Control Motion Noise exists in situations where there is no PFN but the scanned MLS signal indicates a bounce or deviation which an aircraft cannot follow. Initially it was argued that PFN was the driver. The effective sidelobe level required to ensure that the PFN for a 1.5° beamwidth antenna does not exceed 0.083° is −25 dB (a 0 dB ground reflection coefficient is assumed, the 0.083° PFN limit is derived from the ICAO standard that the PFN shall not be greater than plus or minus 1.3 feet). After some analysis by the FAA, it was recognized that with the antenna phase center 20 feet. above the reflecting ground, CMN could be generated when the aircraft was within 2000 feet of the runway threshold. Consequently, in the draft specifications for the FAA second MLS procurement, the effective sidelobe level is specified such that the CMN does not exceed 0.045°. This requires an effective sidelobe level of −30 dB for a 1.5° beamwidth antenna.

Based on the results of simulations of an actual automatic flight control system in service it has been concluded that linearity is the most stringent requirement with respect to the specification of the effective sidelobe level. The results of the simulations indicate that the angle error limit must not exceed 0.024° to ensure performance of an automatic flight control system within passenger comfort levels. This error limit corresponds to a −36 dB effective sidelobe level for a 1.5° beamwidth antenna.

The discussion on the linearity requirement has raised the issue of the measurement methodology for determining compliance with specifications. With regard to this issue it should be recognized that effective sidelobes can be measured on an antenna range and that design approval by an authority can be based on these antenna range measurements.

The sidelobes radiated by the elevation antenna in the direction of the ground are folded back on the main beam because of specular reflection. The sidelobe radiation distorts the beam and causes PFN, CMN and linearity errors. The specification of PFN and CMN limits the magnitude of the angle guidance error. The linearity error, however, depends on the product of the maximum angle guidance error and the height of the antenna phase center above the reflecting ground surface. A large error-height product is capable of causing substantial degradation of the guidance loop gain of an automatic flight control system to the point where the automatic flight control system becomes unstable. For example, a maximum error of 0.045° and a phase center height of 20 feet can cause the loop gain to vary between +6 dB and less than −40 dB (at the "max gain spot" and the "dead spot", see FIG. 11).

The model of a flat horizontal surface is used to quantify the effects of sidelobe radiation on the performance of an automatic flight control system. The geometry and formulas are presented in FIG. 12. For the case of a constant glide path, the magnitude of the error remains essentially constant and the phase variation is that attributed to the path difference between the direct signal and the indirect signal emanating from the ground image of the EL antenna.

The model was used as a perturbation input to a simulation of an automatic glide slope control system for a small jet aircraft. The criteria for the acceptability of the automatic flight control system is passenger comfort. FIGS. 13, 14 and 15 provide a summary of the simulation results with respect to the allowable peak MLS guidance error, elevation antenna phase center height and passenger comfort. The simulations start at a distance of 3 NM from the elevation antenna.

FIG. 13 shows that for a 20 feet phase center height and a peak error of 0.083° the automatic control system is unstable. The vertical accelerations exceed the passenger comfort level by a factor of 2.4:1. For a peak error of 0.045°, the system is marginally stable; for larger phase center heights, say 37 feet, it is expected that the system would be unstable (the error height product, 0.045°×37′, is equal to that of the 0.083° maximum error and 20 feet height case). FIGS. 14 and 15 exhibit the same trends; they show that for a 20 feet phase center height and a peak error of 0.083° the vertical velocity and attitude exceed the passenger comfort levels by factors of 4:1 and 2:1 respectively. The following conclusions are based on a study of the available information, with respect to the specification of the effective sidelobe level and autopilot performance within passenger comfort levels:

1. the present PFN error limit (0.083°) is not acceptable;
2. the present CMN error limit (0.045°) is marginal (especially if higher than 20 feet antenna phase center heights are contemplated);
3. a limit of 0.024° appears to be acceptable for the case studied;
4. linearity is the dominant system requirement with respect to the specification of the effective sidelobe level; and
5. the error-height product should not exceed 0.45 degrees-feet.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. An antenna system for radiating wave energy signals into a selected angular region of space and in a desired radiation pattern, comprising:

special filter means, having N input ports and N corresponding output ports, where N is a number greater than five, comprising a network of couples for coupling signals from each of said input ports to its corresponding output port and to at least two other output ports on at least one side of said corresponding port and with the same phase;

an aperture comprising a plurality of N antenna elements arranged along a predetermined path, each element coupled to only one output port of the special filter means;

beam sterring means for controlling the direction of said radiation pattern, said means comprising N phase shifters. Each phase shifter having a phase shifter input port and a phase shifter output port which output port is coupled to only one input port of said special filter means; and supply means for supplying wave energy signals, said supply means including a signal generator supplying a power divider having N signal output ports, each output port coupled to only one phase shifter;

whereby when wave energy signals are supplied by the signal generator through the power divider, signals supplied by a signal output port of the power divide are coupled to the antenna element associated with said output port and to a least two adjacent antenna elements on at least one side of the antenna element associated with said output port, to cause said aperture to radiate said desired radiation pattern primarily within said selected region of space without grating lobes.

2. The system of claim 1 wherein said spatial filter comprises:

a plurality of N first coupling means each having a first input port, a first coupled output port and a first transmitted output port, said first coupling means for distributing wave energy signals applied to the first input port, such applied signals being distributed to the first coupled output port and to the first transmitted output port according to a first predetermined ratio, said N first input ports being the N input ports of the spatial filter;

a plurality of N second coupling means interspersed between said N first coupling means, each having a second left input port associated with the first coupled output port of the right adjacent first coupling means and a second right input port associated with the first transmitted output port of the left adjacent first coupling means, said second means having a second coupled output port and a second transmitted output port, said second coupling means for combining and distributing wave energy signals applied to the second left and second right input ports, such applied signals being distributed to the second coupled output port and the second transmitted output port according to a second predetermined ratio; and a plurality of N third coupling means interspersed between said N second coupling means, each having a third left input port associated with the second coupled output port of the right adjacent second coupling means and a third right input port associated with the second transmitted output port of the left adjacent second coupling means, said third coupling means having a third output port, said third coupling means for combining wave energy signals supplied to the third left input port and to the third right input port, such applied signals being combined and provided by the third combining output port according to a third predetermined ratio, said N third output ports being the N output ports of the spatial filter.

3. The system of claim 2 wherein said first predetermined ratio equals said third predetermined ratio.

4. The system of claim 3 wherein said second predetermined ratio ($C_2$) is associated to said first predetermined ratio ($C_1$) according to the following:

$$C_1^2 = \tfrac{1}{2}(1 + \sqrt{1 - C_2^2}).$$

5. The system of claim 2, said spatial filter further comprising a plurality of N fourth coupling means located between said second means and said third means, each of said N said fourth means interspersed between said N second coupling means, each having a fourth left input port associated with the second coupled output port of the right adjacent first coupling means and a fourth right input port associated with the second transmission output port of the left adjacent first coupling means, said fourth means having a fourth coupled output port associated with the third right input port and having a fourth transmitted output port associated with the third left input port, said fourth coupling means for combining and distributing wave energy signals applied to the fourth left and fourth right input ports, such applied signals being distributed to the fourth coupled output port and the fourth transmitted output port according to a fourth predetermined ratio.

6. The system of claim 5 wherein said first predetermined ratio equals said third predetermined ratio and said second predetermined ratio equals said fourth predetermined ratio.

7. The system of claim 6 wherein said second predetermined ratio ($C_2$) is associated to said first predetermined ratio ($C_1$) according to the following:

$$C_1^2 = \tfrac{1}{2} = C_2\sqrt{1 - C_2^2}$$

8. The system of claim 1 wherein said spatial filter comprises:

distribution means having N distribution input ports and 2N distribution output ports for distributing wave energy signals applied to said distribution input ports, to such applied signals being distributed to the distribution output ports according to a first predetermined ratio, said N distribution input ports being the N input ports of the spatial filter;

first transmission means having 2N first transmission input ports, each associated with only one of the 2N distribution output ports, and having 2N first transmission output ports, said first transmission means for combining and distributing wave energy signals applied to said first transmission input ports, such applied signals being combined and distributed to the first transmission ports according to a second predetermined ratio;

combining means having 2N combining input ports, each associated with only one of the 2N first transmission output ports, and having N combining output ports, said combining means for combining wave energy signals applied to said 2N combining input ports, such applied signals being combined at the combining output ports according to a third predetermined ratio, said N combining output ports being the N input ports of the spatial filter.

9. The system of claim 8 wherein said first predetermined ratio equals said third predetermined ratio.

10. The system of claim 9 wherein said second predetermined ratio ($C_2$) is associated to said first predetermined ratio ($C_1$) according to the following:

$$C_1^2 = \tfrac{1}{2}(1 + \sqrt{1 - C_2^2}).$$

11. The system of claim 8, said spatial filter further comprising a second transmission means located between said first transmission means and said combining means, said second transmission means having 2N second transmission input ports, each associated with only one of the 2N first transmission output ports, and having 2N second transmission output ports, each associated with only one of the 2N combining input ports, said second transmission means for combining and distributing wave energy signals applied to said second transmission input ports, such applied signals being combined and distributed to the second transmission output ports according to a fourth predetermined ratio.

12. The system of claim 11 wherein said first predetermined ratio equals said third predetermined ratio and said second predetermined ratio equals said fourth predetermined ratio.

13. The system of claim 12 wherein said second predetermined ratio ($C_2$) is associated to said first predetermined ratio ($C_1$) according to the following:

$$C_1^2 = \tfrac{1}{2} + C_2\sqrt{1 - C_2^2}$$

14. The system of claim 1 wherein said filter comprises first and second cascaded spatial filters having N input ports and N output ports.

15. The system any one of claims 2–14 wherein said spatial filter comprises a printed circuit located on a single substrate.

* * * * *